United States Patent [19]

Saunders

[11] 4,377,152

[45] Mar. 22, 1983

[54] CABLE GUARD FOR COMPOUND BOW

[75] Inventor: Charles A. Saunders, Columbus, Nebr.

[73] Assignee: Saunders Archery Co., Columbus, Nebr.

[21] Appl. No.: 302,737

[22] Filed: Sep. 16, 1981

[51] Int. Cl.[3] ..... F41B 5/00

[52] U.S. Cl. ..... 124/88; 124/DIG. 1; 124/23 A; 124/87

[58] Field of Search ..... 124/88, 24 A, 23 A, 124/DIG. 1

[56] References Cited

U.S. PATENT DOCUMENTS 3,286,961 11/1966 Mandolare ..... 124/24 A X
4,054,118 10/1977 McKee et al. ..... 124/23 R
4,162,579 7/1979 James ..... 124/87 X
4,332,231 6/1982 Napier et al. ..... 124/24 R

OTHER PUBLICATIONS

"York's New Excalibre" *Bow and Arrow Magazine* 6/82, pp. 20–23.

*Primary Examiner*—Richard C. Pinkham
*Assistant Examiner*—Scott L. Brown
*Attorney, Agent, or Firm*—Michael G. Berkman

[57] ABSTRACT

In a compound bow, a cable guard characterized in being readily adjustable to provide, selectively, up to about one inch or more of cable deflection or offset. The guard is fastened in place by a plate. This plate provides for the optional attachment of a bowsight and/or a bow quiver.

5 Claims, 6 Drawing Figures

CABLE GUARD FOR COMPOUND BOW

BACKGROUND OF THE INVENTION

This invention relates, generally, to a special accessory for archery use. More particularly, the invention is directed to an adjustable cable guard or deflection rod for use with compound bows.

In a compound bow the pulleys and the cables or strands carried thereby establish a physical condition in which cable strands extend in the spatial zone located between the bowstring upon which the arrow is nocked and the hand grip portion of the bow itself. In the arrangement described, the arrowshaft (and/or the arrow fletching) comes into contact with the intermediate strands, so that the strands interfere with and constitute a distinct impediment to accurate release of the arrow in flight.

It has, accordingly, become a common practice when using compound bows to rely upon a deflection rod or cable guard to control the cables of the bow. The rod is attached to the bow near the handle and extends rearwardly therefrom to engage and urge the intermediate strands laterally, out of the line of flight of the arrowshaft. For the most part, prior art cable guards have allowed no adjustment in the degree or extent to which the cables are moved, displaced or deflected. The prior art cable guards have no capability for adaption to the unique demands of a particular compound bow, or to the subjective preferences of the archer.

It is, therefore, a principal aim of the present invention to provide an improved cable guard which may be readily and simply adjusted to provide a selectible optimum degree of cable deflection appropriate for a given compound bow. Such optimization contributes to archery accuracy and obviates objectionable chatter.

SUMMARY OF THE INVENTION

It is a principal object of the invention to provide, for compound bows, a cable guard or cable deflector which is adjustable, making it possible to achieve, selectively, up to about 1 inch or more of displacement of intermediate cable strands to provide arrow shaft and fletching clearance.

A related object of the invention is to provide a cable guard having adjustment capabilities and in which the adjustment desired is carried out simply and without a need for specialized tools or accessories.

Yet another feature of the improved cable guard of the invention is that it may simply and effectively be adapted for optimum operation on various types of compound bows.

A general advantage of the cable guard of the invention is that it ensures optimum cable clearance with minimum friction and wear.

A collateral advantage of the cable guard of the invention is that the mounting plate used includes means for attachment of a bow quiver and/or a bowsight, if desired.

A general structural feature of the cable guard of the invention is that it is fabricated of a light-weight metal such aluminum or of an aluminum or magnesium alloys.

Other and further advantages, features, and objects of the invention will become evident upon consideration of the drawing and the specification.

DETAILED DESCRIPTION OF PREFERRED EMBODIMENT

The aims and objects of the invention are achieved by providing in a cable guard for use with a compound bow a simple yet highly effective means by which the degree of cable deflection or displacement achieved by the guard is readily and simply adjusted to a preferred degree.

Specifically, adjustability is achieved by providing an eccentric mechanism constituting adjustable mechanical means for displacement or frictional positioning of the cable-engaging rod or the cable guard. In order to achieve that degree of cable deflection which is desired, it is necessary merely to loosen the deflecting rod in its clamp, and then to rotate the rod to the desired degree and, finally, lock it in stressing engagement against the cables to be controlled.

Figure 1:
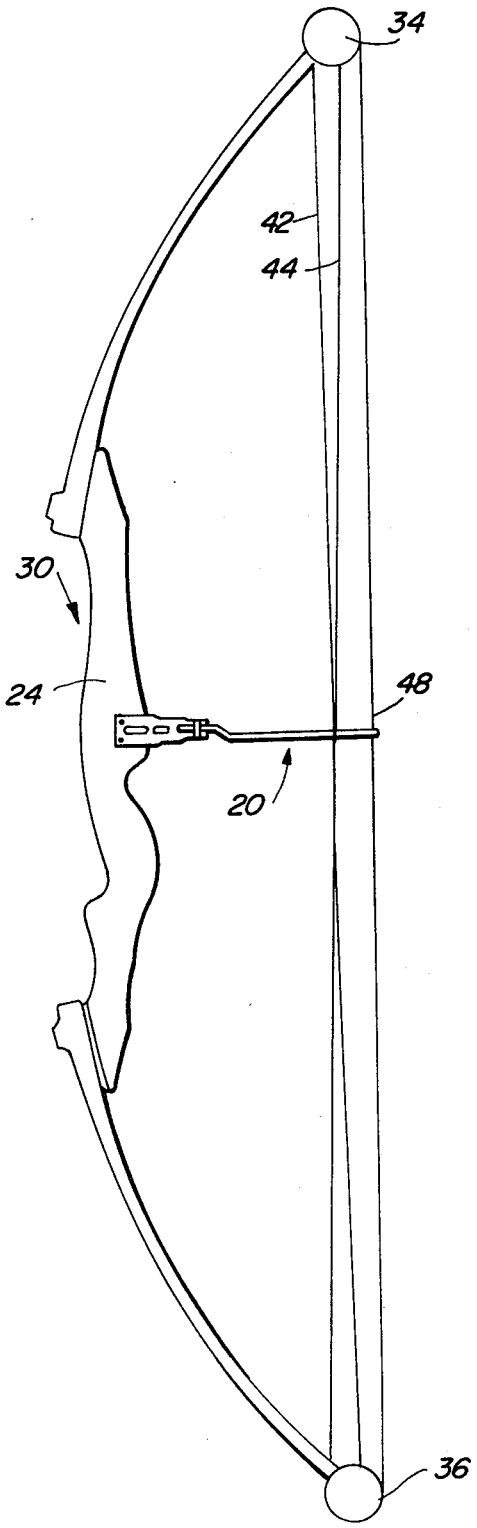
FIG. 1 is a side elevational view showing the cable guard of the invention fastened to a compound bow.
Figure 2:
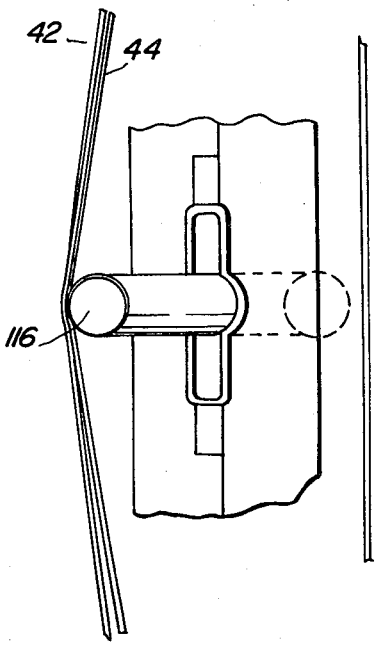
FIG. 2 is a fragmentary, enlarged, perspective view illustrating the manner in which the bar of the cable guard of the invention deflects the intermediate cables or the bow strands.
Figure 3:
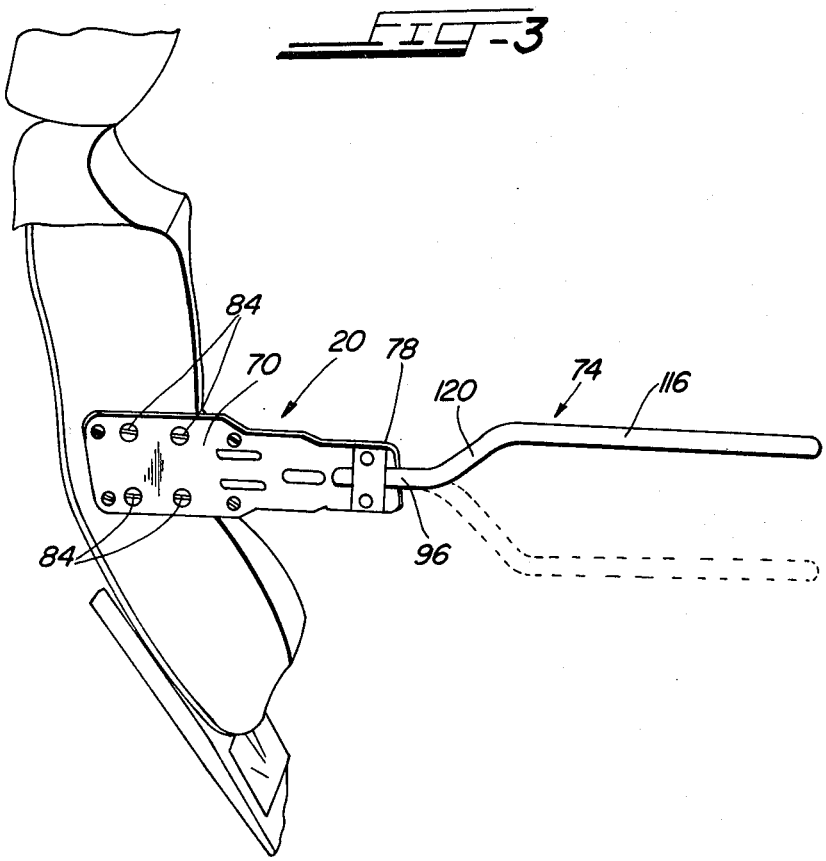
FIG. 3 is a fragmentary, enlarged view showing the manner in which the cable guard of the invention is fastened to the handle of the compound bow.
Figure 4:
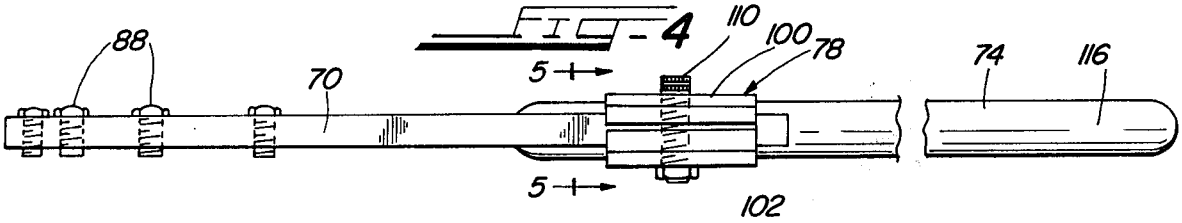
FIG. 4 is a top plan view of the cable of the guard of the invention.
Figure 5:
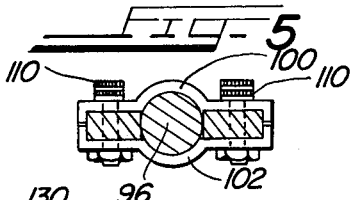
FIG. 5 is a cross sectional view taken substantially on the lines 5—5 of FIG. 4.
Figure 6:
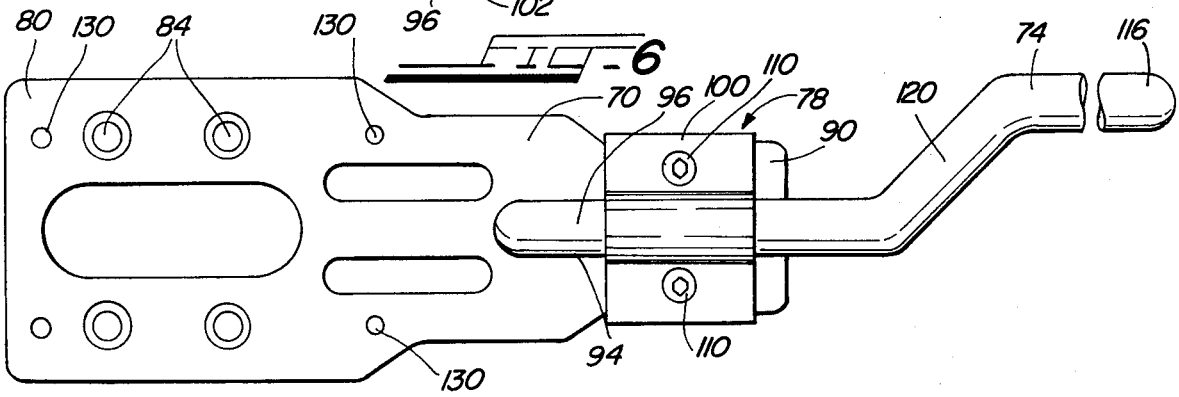
FIG. 6 is a side-elevational view of the cable guard of the invention illustrating the manner in which the deflection bar is secured for selective rotational positioning.

Referring now to the drawings, and particularly to FIGS. 1 through 3, for purposes of disclosure, a preferred embodiment of the invention is shown as comprising a cable guard assembly 20 firmly fastened to the handle riser section 24 of a compound bow 30. The bow 30 shown is provided with a pair of pulleys including an upper pulley 34 and a lower pulley 36. A multistrand cable 40 including inner strands 42 and 44 and outer strand 48 is trained through the pulleys, 34 and 36 as shown in FIG. 1, in a manner well-known in the art.

As seen most clearly in FIG. 1, the run of the outer cable strand 48 constitutes that bow strand upon which the arrow (not shown) is nocked.

Also as clearly shown in FIG. 1, the bow cable 40 includes two lengths or strands 42 and 44 which lie in a zone between the nocking strand 48 and the bow grip 24. The cable strands 42 and 44 lie in substantially the same plane as the bow handle and the nocking strand 48 so that the strands 42 and 44 interfere with the placement of the arrow on the bowstring 56 and on the arrow rest (not shown).

It will be understood and appreciated that it is desirable to displace the inner strands 42 and 44 laterally, particularly at the center portions of these strands, which occupy the same zone in which the arrow vane lies before the start of the draw. It is the function of the cable guard 20 of the invention to provide this desirable displacement of the interfering cable strands 42 and 44.

While the general positioning of the cable guard 20 of the invention on the compound bow 30 is shown in FIG. 1, the precise mode of attachment and of adjustment of the device is described with reference to FIGS. 3 through 6. As shown, the cable guard 20 comprises a mounting plate 70, a rotatable rod or bar 74, and a clamping assembly 78 by means of which the rod 74 is secured to the mounting plate 70. The mounting plate 70 is, in the particular embodiment of the invention illustrated, about ⅛ to about 3/16 inch in thickness, about 5¼ inches long and about 2 inches wide. At its end 80 fastened to the bow grip section 24 of the bow 30, the mounting plate 70 is formed with a series of holes 84 for receiving screws or bolts 88 by means of which the mounting plate 70 is secured to the bow handle 24.

At its end 90, opposite the end 80 which is attached to the bow handle 24, the mounting plate 70 is formed with a longitudinal, outwardly opening slot 94 about 2 inches long and having a cross width sized to accommodate the transverse dimension or diameter of the deflection rod 74. The segment of the rod 74 which seats in the slot 82 is retained in place by means of a pair of generally U-shaped clamps 100 and 102 positioned on to embrace opposed sides of the mounting plate 70 and firmly sandwich the deflection rod 74 therebetween. Nut and bolt assemblies 110 include bolts 114 which pass through the mounting plate 70 and through the clamps 100 and 102 so that the latter may be urged against securely to hold the deflection rod 74 in place, all as clearly shown in FIGS. 3, 5 and 6. In the specific preferred embodiment of the apparatus shown, the bolts 114 have non-circlar recessed sockets for accommodating an Allen wrench.

It is a principal feature of the improved cable guard 20 of the invention that the cable displacement rod 74 is other than of a straightline configuration. As shown, the rod 74 is of unitary construction and consists of three interconnected segments or sections. The first segment 96 is held clamped to the mounting plate 70. A second lineal segment 116 of the deflection rod 74 is displaced or offset from but generaly parallels the locked segment 96, and an intermediate lineal segment 120 is interposed between and interjoins the two end segments 96 and 116.

Based upon the foregoing description, it will be appreciated that as the cable deflecting rod 74 is rotated in the clamping assembly 78, it is possible through selective rotational positioning of the rod 74 to achieve a preferred displacement of the end 116 of the deflection rod 74 as a function of the eccentric rod-mounting system employed. The shifting locus of the cable-engaging portion 116 of the deflection rod 74 is indicated schematically in FIG. 3 and is evident upon comparison of the solid line representation of the rod 74 and the dotted line representation. The overall "lateral" shift achieved, and significant in displacing the intermediate cables 42 and 44 is, in the particulr embodiment of the apparatus illustrated, about 1 inch.

Accordingly, in order to realize the precise degree of cable displacement preferred, it is necessary merely to loosen the locking assembly 78, to rotate the rod 74 to achieve the preferred displacement of the contacted cable strands 62 and 64, and then to relock the rod 74 in the clamping assembly 78 so that the cable-engaging sector 116 of the rod 74 bears against the cables 42 and 44 and retains them in a displaced mode.

Optionally, a bowsight and/or bow quiver may be fastened to the mounting plate 70, a series of tapped holes 130 being provided in the plate 70 for that purpose.

While the invention has been described in detail with reference to a preferred embodiment, it is evident that numerous obvious changes may be made in the apparatus described and still accomplish the aims of the present invention. In the light of the present disclosure, all such variations and modifications may be made without an exercise of the inventive faculty; all such variations are deemed to come within the spirit and scope of the appended claims.

What is claimed is:

1. In a cable guard for use with a compound archery bow and including a bow-handle-mounting bracket and cable guard rod means carried thereby, said rod means being adapted for engaging and deflecting cable strands of the compound bow physically to prevent interfering contact of the cable strands with an arrow during impelling flight of the arrow from the bow and obviating impairment of true flight of an arrow released from the bow, said mounting bracket including means for supporting said cable guard rod means in stable relationship therewith to extend essentially transversely of the cable strands and proximate thereto, the improvement comprising rod adjustment means for selectively regulating the extent to which said cable guard rod means deflects the cable strands through controlled displacement of the strands from an arrow show movement path delineated by a zone established by an arrow nocked on a bowstring of a compound bow and readied for a shooting sequence, said adjustment means comprising an intermediate lineal segment of said rod means joined to and interposed between a freely extending section of said rod means and a bracket-secured section of said rod means held by said mounting bracket, said intermediate lineal segment of said rod means comprising offset means for establishing distinct but essentially parallel longitudinally extending axes of rotation for said freely extending section and for said secured section of said rod means, said bracket means clamping said rod means for selective rotational positioning to render a rotational axis of said freely extending section of said rod means eccentric with respect to a longitudinal axis of said secured section of said rod means, thereby to permit selectable degrees of lateral displacement of the cable strands as said freely extending section of said rod means is brought to bear against and shift the cable strands from an arrow flight zone.

2. The improvement as set forth in claim 1 wherein said freely extending section and said secured section of said rod means are offset about one inch from one another selectively to permit up to about one inch of deflection of the cable strands of the compound bow.

3. The structure as set forth in claim 1 and further comprising means carried by said mounting bracket for attachment of bowsight thereto.

4. The structure as set forth in claim 1 and further comprising means carried by said mounting bracket for attachment of a bow quiver thereto.

5. The improvement as set forth in claim 1 wherein said rod means comprises a bar circular in transverse cross section and further comprising clamp means carried by said mounting bracket and frictionally securing said bar in said mounting bracket.

* * * * *

UNITED STATES PATENT OFFICE

CERTIFICATE OF CORRECTION

Patent No. 4,377,152 Dated March 22, 1983

Inventor(s) Charles A. Saunders

It is certified that error appears in the above-identified patent and that said Letters Patent are hereby corrected as shown below:

Column 4, Line 28, cancel the words "show movement" and substitute therefor --shaft flight---

Signed and Sealed this

*Twenty-seventh* Day of *September 1983*

[SEAL]

*Attest:*

GERALD J. MOSSINGHOFF

*Attesting Officer* *Commissioner of Patents and Trademarks*